US006484361B1

(12) United States Patent
Schmid et al.

(10) Patent No.: US 6,484,361 B1
(45) Date of Patent: Nov. 26, 2002

(54) HANDLE FOR A DRILL- AND/OR CHISEL HAMMER

(75) Inventors: Wolfgang Schmid, Munich; Rudolf Berger, Grünwald, both of (DE)

(73) Assignee: Wacker-Werke GmbH & Co. KG, Munich (DE)

( * ) Notice: Subject to any disclaimer, the term of this patent is extended or adjusted under 35 U.S.C. 154(b) by 0 days.

(21) Appl. No.: 09/623,957

(22) PCT Filed: Mar. 26, 1999

(86) PCT No.: PCT/EP99/02060

§ 371 (c)(1),
(2), (4) Date: Sep. 7, 2000

(87) PCT Pub. No.: WO99/50030

PCT Pub. Date: Oct. 7, 1999

(30) Foreign Application Priority Data

Mar. 30, 1998 (DE) ..... 198 14 175

(51) Int. Cl.[7] ..... B25G 1/00

(52) U.S. Cl. ..... 16/110.1; 16/426; 16/436; 81/489; 81/DIG. 12; 173/162.2; D8/315; D8/DIG. 7

(58) Field of Search ..... 16/110.1, 430, 16/426, 436, 421; 81/489, 492, DIG. 12; 173/18, 162.2, 171; 74/493, 492, 504, 543; D8/80, 306, 315, DIG. 7

(56) References Cited

U.S. PATENT DOCUMENTS

| | | | | | |
|---|---|---|---|---|---|
| 2,545,659 | A | * | 3/1951 | Ginter | 16/426 |
| 4,276,675 | A | * | 7/1981 | Pioch | 16/426 |
| 4,820,090 | A | * | 4/1989 | Chen | 16/431 |
| 5,025,870 | A | * | 6/1991 | Gantner | 173/162.2 |
| 5,690,451 | A | * | 11/1997 | Thurler et al. | 408/113 |
| 5,725,422 | A | | 3/1998 | Leweck | |
| 6,076,616 | A | * | 6/2000 | Kramp et al. | 173/162.2 |

FOREIGN PATENT DOCUMENTS

| | | | | |
|---|---|---|---|---|
| DE | 32 29 183 A | | 2/1984 | |
| DE | 88 09 840 U | | 11/1989 | |
| DE | 196 06 498 A | | 8/1997 | |
| EP | 0 493 033 A | | 7/1992 | |
| GB | 2124536 | * | 2/1984 | B25D/17/04 |

* cited by examiner

*Primary Examiner*—Lynne H. Browne
*Assistant Examiner*—Doug Hutton
(74) *Attorney, Agent, or Firm*—Boyle Fredrickson Newholm Stein & Gratz S.C.

(57) ABSTRACT

A handle for a drill- and/or chisel hammer has a mount which can be fixed to the hammer. A radial grip is fixed to said mount, the grip axis of said radial grip crossing a tool axis which is defined by the position of a tool received by the hammer. A tangential grip is also fixed to the mount. Said tangential grip has a first grip section whose grip axis is tangential to the tool axis and a second grip section whose grip axis is tangential to the tool axis and essentially perpendicular to the grip axis of the first grip section.

18 Claims, 4 Drawing Sheets

HANDLE FOR A DRILL- AND/OR CHISEL HAMMER

BACKGROUND OF THE INVENTION

1. Field of the Invention

This invention pertains to a supplemental handle for a hammer drill and/or a hammer chisel as well as a hammer drill and/or a hammer chisel containing the supplemental handle.

2. Description of the Related Art

For hammer drills, it is known from E 196 06 498 A1, for example, to use radial grips that can be fastened by the user to any desired radial position relative to the tool axis, which is defined by the longitudinal axis of the drill. This is done by means of a collar around the tool axis that can be fastened to the hammer housing. In hammer chisels, a so-called spade grip has proven useful that tilts about the chisel axis and also can be tilted about an axis perpendicular to the chisel axis into certain notch positions toward or away from the chisel. A similar handle is known from DE 32 29 183C2.

In DE-AS 1 427 734, a percussion drilling machine is described in which a radial handle is screwed into the housing of the drilling machine.

So-called combination hammers, i.e. hammers that are suitable both for drilling as well as chiseling, are commonly only provided with one handle variation suitable for one type of use, which is less suitable for the other type of use. If, therefore, the user wishes to switch between chiseling and drilling, it is often necessary to exchange the handle, which can be costly. Also, quickly changing the current grip position is possible only by altering or repositioning the respective handle.

From DE-U-88 09 840, a combination hammer is known to which a supplemental handle can be fastened by means of a mounting support. The supplemental handle consists of a radial grip that can be fastened directly to the mounting support and a tangential grip that can be fastened to the mounting support by means of a traverse.

The objective of this invention is to provide a universal supplemental handle that is equally suitable for drilling and for chiseling and that offers the user a number of ergonomically practical grip positions without expending work to reposition, or with minimal work to reposition.

This objective is met according to the invention by means of a handle with the features of patent claim 1. Advantageous further developments of the invention are found in the dependent claims.

According to the invention, a supplemental handle for a hammer drill and/or hammer chisel is provided that has a mounting support, a radial grip that can be fastened to the mounting support or directly to the hammer and whose grip axis is essentially radial to a tool axis defined by the position of a tool held by the hammer, and with a tangential grip that can be fastened to the mounting support. A first grip section of this tangential grip has a grip axis that runs essentially perpendicular to and at a distance from the tool axis, and a second grip section has grip axis that runs essentially perpendicular to and at a distance from the tool axis and essentially perpendicular to the grip axis of the first grip section.

By providing two types of handles according to the invention, namely a radial grip for the drill and a tangential grip for the chisel, it is possible to switch between the different modes of operation without having to change to a different handle accordingly. The especially advantageous design of the tangential grip, namely dividing it into a first grip section and a second grip section perpendicular to the first, enables the user to guide the hammer very comfortably, especially when chiseling.

The handle arrangement according to the invention ensures that all handle elements are located only in one quadrant of a plane perpendicular to the tool axis. This allows the other three quadrants of the plane to be kept open by the handle system so that it is also possible to drill or chisel right up against walls or in comers. The three handle sections offer three grip possibilities for an optimum support of the moments occurring when working.

By arranging its grip sections open upward, the tangential grip is designed so that the hand can be removed from the grip quickly at all times and—for example when the drill is unexpectedly seized—the hand does not get caught.

In an especially advantageous further development of the invention, the radial grip is fastened removably to the mounting support, wherein its removal does not influence the fastening of the tangential grip. This makes it possible to quickly remove it from the mounting support and, for example, to fasten it at another position directly to the hammer, which is especially advantageous for vertical drilling downward.

In another advantageous further development of the invention, the tangential grip is fastened to the mounting support and can be tilted about an axis perpendicular to the tool axis. This ensures that the tangential grip can be tilted in the direction of the chisel, for example when setting the chisel or, when drilling or chiseling, perpendicular downward, or backward away from the chisel so that the user can create the best grip situation accordingly. The tilting of the tangential grip is possible without influencing the fastening of the radial grip.

An additional advantage is a locking element provided to lock the tangential grip to the mounting support wherein catches ensure form-locked positioning of the tangential grip relative to the mounting support and thus ensure a secure connection between the tangential grip and the mounting support during operation.

BRIEF DESCRIPTION OF THE DRAWINGS

This and other features and advantages of the invention are explained in more detail below with the help of an example and resorting to the accompanying figures. Shown are:

In FIGS. 1 and 2, a hammer 1 is shown that is used as a hammer drill and chisel hammer, which has a handle 2 at its rear containing the on/off switch in a common fashion.

Figure 1:
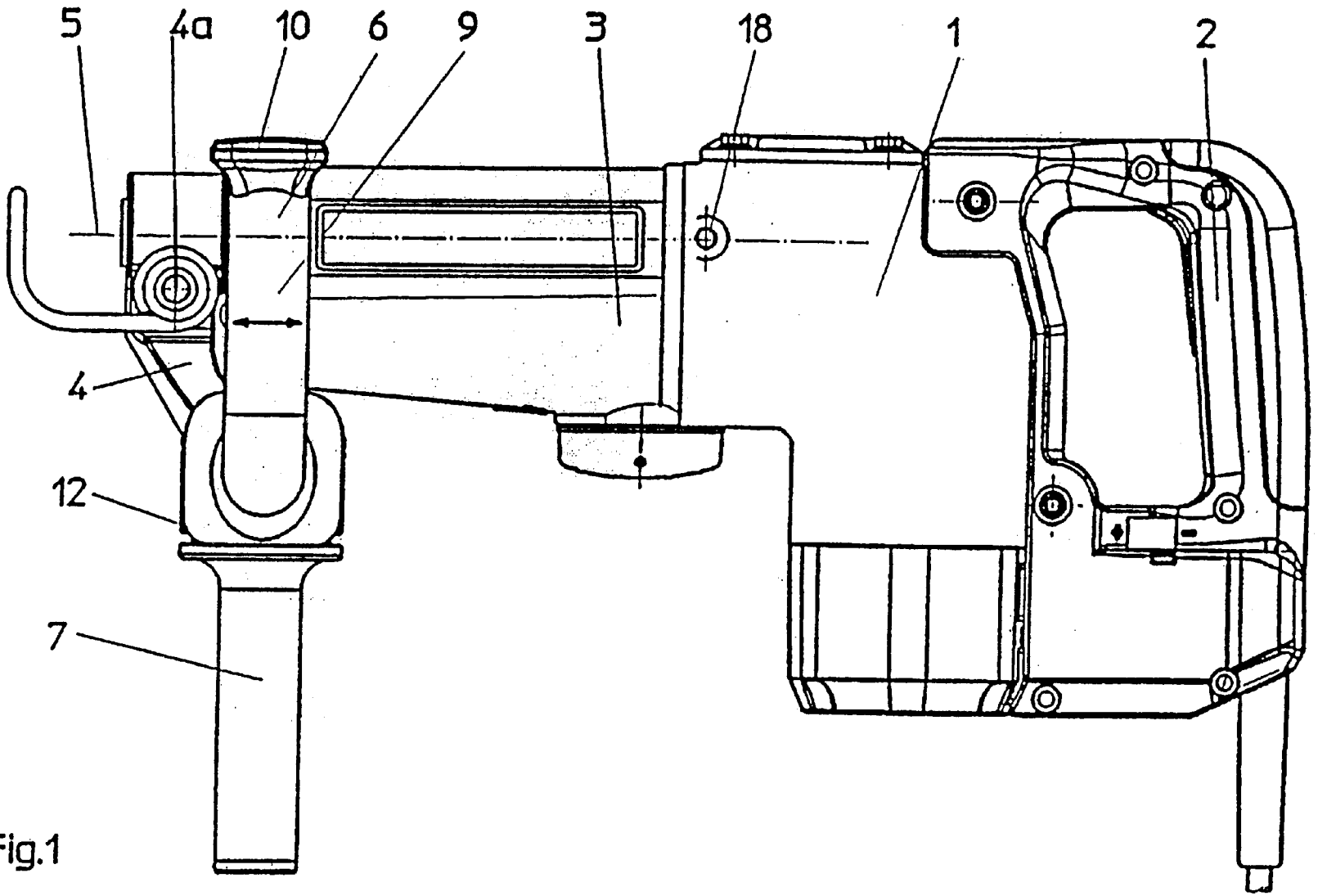
FIG. 1 a hammer in a side view with the handle according to the invention.

At the front end of a hammer housing 3 is a mounting support 4 installed in a known fashion. The hammer housing 3 usually houses the transmission in this area and can be made of plastic or metal. The mounting support 4 is pushed onto the hammer housing 3 in the direction of a tool axis 5 and is fixed at one end of the hammer housing 3 by means of a known clamping mechanism, which serves as a fastening element 4*a*, at any desired angular position relative to the tool axis 5.

The mounting support 4 should be mounted such that its other end extends below the hammer housing 3. Then, at its bottom side it holds a tangential grip 6 and a radial grip 7. The tangential grip 6 has a first grip section 8 and a second grip section 9 perpendicular to and connected to the first grip section 8 in one piece. To better understand this, the grip axes in the respective grip sections 8, 9 are indicated as dashed-dotted lines in FIG. 2. The free end 10 of grip section 9 is broadened and shaped like a spade so that the user can get a more secure grip of the tangential grip 6 and to prevent an inadvertent slipping off of the second grip section 9. For the same reason, the end 11 of the first grip section 8 at the side nearest the hammer is also broadened. Broadening the end 11 nearest the hammer also guarantees that the user is protected against getting burned at the hammer housing, which is mostly made of metal. Also, the user's hand is protected against electric shock that could otherwise spark from the hammer housing 3 if an electric line is inadvertently drilled.

Figure 3:
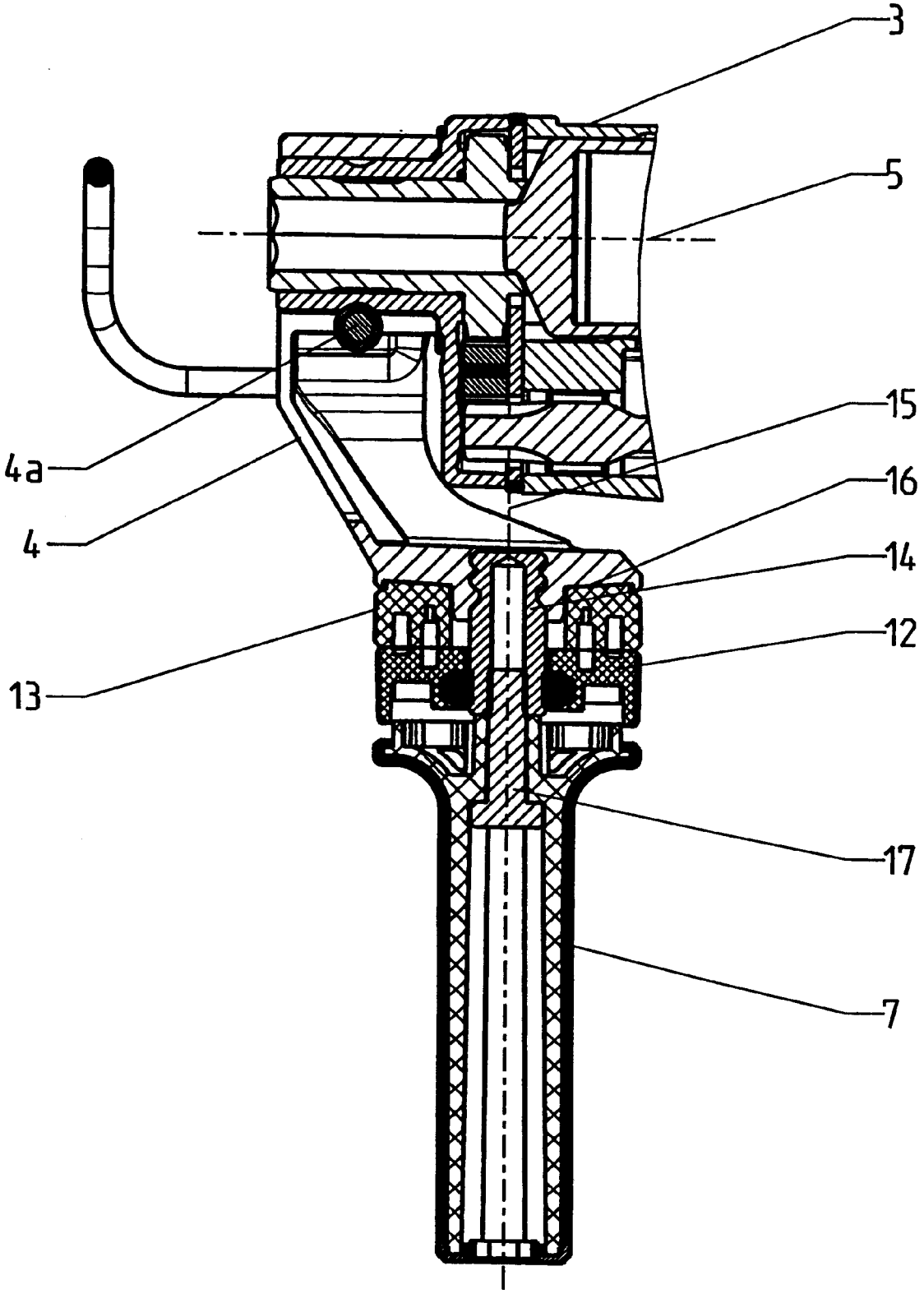
FIG. 3 a partial section of the handle in FIG. 1.
Figure 4:
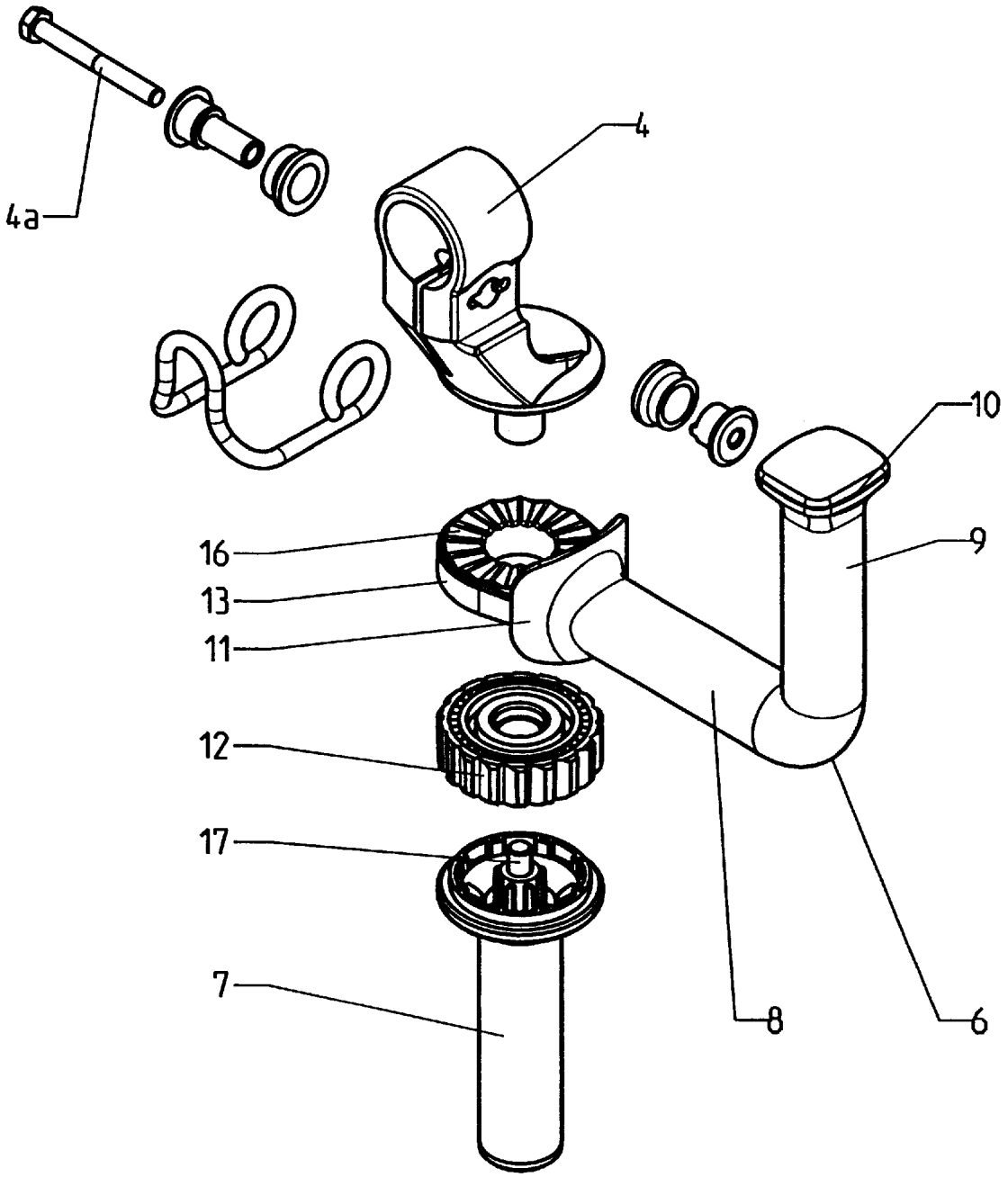
FIG. 4 an exploded view of the handle of FIG. 1.

The tangential grip 6 is fastened to the mounting support 4 by means of a locking wheel 12 that serves as a locking element. The locking wheel 12 is screwed into the mounting support 4 —as shown in FIG. 3 also—and clamps a flat area 13 of the tangential grip 6 between itself and the mounting support 4. After loosening the locking wheel 12, the tangential grip 6 can be tilted about a stem 14 in the direction of the arrow shown in FIG.1. This stem 14 extends along an axis 15 that intersects perpendicular to the tool axis 5. This makes it possible to tilt the tangential grip 6 in the direction of the tool, not shown, which improves the ability to guide the tool. Also, the tangential grip 6 can be tilted backward toward the main grip 2—for example when working in locations that are difficult to access.

In the desired position, the locking wheel 12 is again tightened, resulting in the catches 16 engaging between the tangential grip 6 and the mounting support 4 and positioning the tangential grip 6 and the mounting support 4 form-locked to one another. This prevents inadvertent gradual movement if the locking wheel 12 has not been sufficiently tightened. Examples of suitable catches 16 are grooves in the flat area 13 of the tangential grip 6 and in the mounting support 4.

Figure 2:
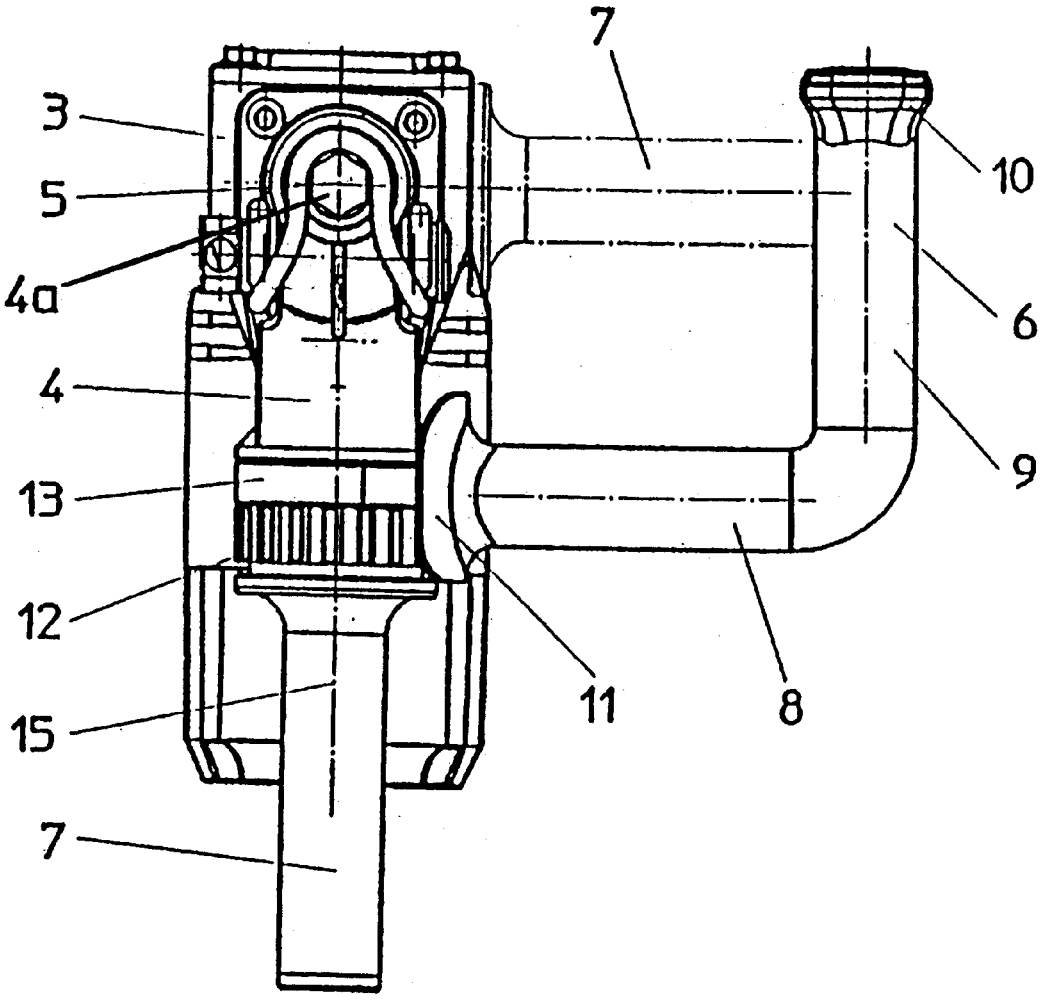
FIG. 2 a frontal view of the hammer with the handle in FIG. 1, seen from the left.

Below the locking wheel 12, the radial grip 7 is screwed in with a threaded pin 17. The grip axis 15 of the radial grip 7 shown by dashed-dotted line intersects the tool axis 5 perpendicularly. In cases where it is more appropriate for ergonomic reasons to hold the hammer only at the main rear grip section, the radial grip 7 can be unscrewed from the locking wheel 12 and instead screwed into a threaded hole 18 provided at the hammer housing 3. In this case, the grip axis 15 of the radial grip 7 no longer has to necessarily intersect the tool axis 5 perpendicularly. In FIG. 2, a dashed line shows this position of the radial grip 7.

What is claimed is:

1. A supplemental handle for a hammer comprising:

a mounting support;

a radial grip which can be selectively fastened either to the mounting support or directly to the hammer; the radical grip having a grip axis which is arranged essentially radial to a tool axis defined by the position of a tool held by the hammer; and a tangential grip that can be fastened to the mounting support the tangential grip including a first grip section having a grip axis that runs essentially perpendicular to and at a distance from the tool axis and a second grip section having a grip axis that runs essentially perpendicular to and at a distance from the tool axis and essentially perpendicular to the grip axis of the first grip section.

2. A supplemental handle according to claim 1, wherein the mounting support can be fastened to the hammer via a fastening element.

3. A supplemental handle according to claim 1, wherein the radial grip is removably fastened to the mounting support.

4. A supplemental handle according to claim 1, wherein the tangential grip is fastened to the mounting support and can rotate about an axis that is perpendicular to the tool axis.

5. A supplemental handle according to claim 4, wherein a locking element is provided to lock the tangential grip to the mounting support.

6. A supplemental handle according to claim 4, wherein catches are provided to position the tangential grip form-locked relative to the mounting support.

7. A supplemental handle according to claim 2, wherein the mounting support is fastened to a housing of the hammer such that it wraps around the tool axis.

8. A supplemental handle according to claim 1, wherein the mounting support can be rotated in a plane perpendicular to the tool axis and can be locked in any desired position.

9. A hammer with a supplemental handle according to claim 1, wherein the radial grip can be directly fastened to the hammer.

10. A supplemental handle for a hammer comprising:

a mounting support;

a radial grip configured to be selectively fastenable to either the mounting support or directly to the hammer, wherein a grip axis of the radial grip is arranged essentially radial to a tool axis defined by the position of a tool held by the hammer; and a tangential grip configured to be fastenable to the mounting support, the tangential grip having a first grip section having a grip axis that runs essentially perpendicular to and at a distance from the tool axis and a second grip section having a grip axis that runs essentially perpendicular to and at a distance from the tool axis and essentially perpendicular to the grip axis of the first grip section.

11. A supplemental handle according to claim 10, wherein the mounting support is fastened to the hammer with a fastening element.

12. A supplemental handle according to claim 10, wherein the radial grip is removably fastened to the mounting support.

13. A supplemental handle according to claim 10, wherein the tangential grip is fastened to the mounting support and can rotate about an axis that is perpendicular to the tool axis.

14. A supplemental handle according to claim 13, further comprising a locking element that locks the tangential grip to the mounting support.

15. A supplemental handle according to claim 13, further comprising catches which position the tangential grip form-locked relative to the mounting support.

16. A supplemental handle according to claim 11, wherein the mounting support is fastened to a housing of the hammer such that it wraps around the tool axis.

17. A supplemental handle according to claim 10, wherein the mounting support can be rotated in a plane perpendicular to the tool axis and can be locked in any desired rotational position.

18. A hammer with a supplemental handle according to claim 10, wherein the radial grip can be directly fastened to the hammer.

* * * * *